United States Patent [19]

Gross et al.

[11] 4,334,848

[45] Jun. 15, 1982

[54] APPARATUS FOR CENTRIFUGAL MOLDING OF CONCRETE PIPE

[75] Inventors: Paul Gross, Neftenbach; Ruedi Kleeli, Winterthur, both of Switzerland

[73] Assignee: Georg Fischer Aktiengesellschaft, Schaffhausen, Switzerland

[21] Appl. No.: 127,073

[22] Filed: Mar. 4, 1980

[30] Foreign Application Priority Data

Mar. 8, 1979 [CH] Switzerland ..... 2230/79

[51] Int. Cl.[3] ..... B28B 21/24

[52] U.S. Cl. ..... 425/262; 264/311; 425/426

[58] Field of Search ..... 425/262, 426, 311

[56] References Cited

U.S. PATENT DOCUMENTS 3,358,342 12/1967 Spence ..... 425/262

3,746,494 7/1973 Gauger ..... 425/262

*Primary Examiner*—James H. Derrington

*Attorney, Agent, or Firm*—Toren, McGeady & Stanger

[57] ABSTRACT

In radially centrifugally molding sections of concrete pipe with a bell at one end, the concrete is poured downwardly into an upwardly extending mold which forms the outer surface of the pipe section. The lower end of the mold is shaped to form the bell end of the pipe section. The concrete is centrifugally forced outwardly against the inner surface of the mold and then is pressed outwardly by a series of rotatable rollers. A pressure wheel is located within the mold above the position of the rollers for limiting the upward movement of the concrete pressed outwardly against the mold and for increasing the concrete pressure acting downwardly toward the bell end of the concrete pipe section.

11 Claims, 2 Drawing Figures

APPARATUS FOR CENTRIFUGAL MOLDING OF CONCRETE PIPE

SUMMARY OF THE INVENTION

The present invention is directed to a radial centrifugal molding of sections of concrete pipe in a mold with the lower end of the mold being shaped to form the bell end of the pipe section. A drum is rotatably mounted on a shaft which extends downwardly into the mold, rotatable rollers are positioned above the drum and press the poured concrete against the inside wall of the mold.

Concrete pipes formed by pressing the concrete radially outwardly within a mold have the bell end of the pipe sections either at the top or bottom end of the mold. One piece molds are used or the mold can be divided into two or more parts which extend in the longitudinal direction of the mold. It is also known to use so-called spring form molds.

When the bell is formed at the upper end of the mold it is necessary to precure or preharden the concrete pipe within the mold. Accordingly, it is not possible to strip or remove the form directly after the compression molding because of the heavy bell end. Precuring may take an hour or more.

As a result, a relatively large number of molds are needed, for example 12 to 20, to be able to carry out continuous production, since each concrete pipe section must cure for at least an hour before the mold can be removed.

If the bell end is located at the bottom of the mold, the immediate removal of the formwork is possible permitting the concrete pipe sections to be continuously produced on a rotary table using only 2 to 4 molds which are continuously emptied. The mold can be removed immediately after the section of concrete pipe is molded and can be immediately placed on the rotary table for the production of another section of concrete pipe.

A disadvantage of this last-mentioned embodiment resides in the fact that the strength of the bell is low because of the inadequate density of the concrete which results in problems with respect to the strength and sealing ability of the pipe.

To increase the strength in the region of the bell when it is formed at the bottom of the mold, a vibration device has been used which acts on the support for the lower wall of the bell. Due to the resulting vibrations, the strength in the region of the bell can, in most cases, be increased to a sufficient degree. To obtain this goal, however, frequently additional measures were required, for example, different concrete mixes were used for the bell and the remainder of the concrete pipe section. Vibrating the bell end of the form resulted in additional disadvantages in the shaking of the apparatus used and in the generation of a significant amount of noise. Accordingly, the service life of the apparatus was reduced and the working conditions in the production plant became more difficult.

Using different concrete mixes in producing a concrete pipe section tends to complicate the production procedure and results in strength problems at the transition in the pipe section between the different concrete mixes. Furthermore, applying vibration frequently resulted in separation cracks between the bell and the remainder of the concrete pipe section.

In U.S. Pat. No. 3,276,091 an embodiment is disclosed where the bell is located at the bottom of the pipe section. In forming the pipe section, concrete is supplied from above onto a rotating plate on which additional wings are mounted which extend approximately in axial planes and throw the concrete against the inside surface of the mold.

Beneath the rotating plate, rotatable rollers are mounted which press the concrete against the inside surface of the mold. In this arrangement, the axes of the rollers extend parallel to the axis of the pipe. A drum is positioned below the rollers and also rotates for smoothening the inside surface of the concrete pipe. The drum rotates about an axis which coincides with the axis of the concrete pipe.

Although this process is frequently satisfactory for the production of the pipe wall, the strength of the bell end is insufficient for many applications. During the rotary movement of the rollers, the concrete is pressed against the inside surface of the mold. The concrete, however, can flow not only downwardly but also upwardly and takes the path of least resistance. Experience has shown that the concrete will move upwardly to a great extent under pressure, so that it performs a circular movement along the inside surface of the mold in the upward direction. Such movement reduces the pressure of the concrete acting downwardly into the bell, with the result that the concrete in the bell region is relatively loose. Such a disadvantage can be eliminated, in part, by using a vibration device for increasing the density of the concrete in the bell.

In another arrangement disclosed in U.S. Pat. No. 3,096,556, an upper rotor is arranged above the rollers. This arrangement, however, is not designed for the production of pipes where the bell is located at the bottom. The rotor does not have a continuous zone or region between the shaft and the periphery so that the downward flow of concrete is impaired. In addition, the movement of the concrete from the inside surface of the mold toward the axis and toward the bottom is stopped.

In this arrangement, the diameter of the upper rotor is smaller than the diameter of the lower rotor. Accordingly, the upper rotor is unable to increase sufficiently the downward pressure on the concrete for the production of tubes where the bell is formed in the bottom mold.

Therefore, it is the primary object of the present invention to provide an arrangement for radial centrifugal molding of concrete pipe where the bell of the pipe section is located at the bottom and where the disadvantages of previously known arrangements are overcome. In particular, the downward pressure on the concrete acting in the region of the bell should be greater than in the past without requiring any vibration device or the use of different concrete mixes.

In accordance with the present invention, a pressure wheel is positioned within the mold above the rollers and in contact with the concrete pressed against the inside surface of the mold. The pressure wheel limits the upward flow of concrete along the inside surface of the mold and, in turn, increases the concrete pressure acting downwardly toward the space in the mold in which the bell is formed. Different arrangements of the pressure wheel are possible.

Compared to the known arrangement, the production of concrete in accordance with the present invention has the advantage that the circular movement of the concrete in the upward direction along the inside surface of the mold is limited and, therefore, the downward pressure developed in the concrete is increased in the direction toward the bell end of the pipe section being formed.

By eliminating the use of a vibration device, the apparatus used has a longer service life and relatively noise-free operation is ensured. Additionally, the cost of the apparatus is lowered and the process is simplified, particularly because only one concrete mix is utilized.

In one embodiment, the pressure wheel has an upper circular cylindrical section and a lower truncated cone-shaped section which tapers inwardly in the downward direction and increases the downwardly directed pressure within the concrete.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DETAIL DESCRIPTION OF THE INVENTION

Figure 1:
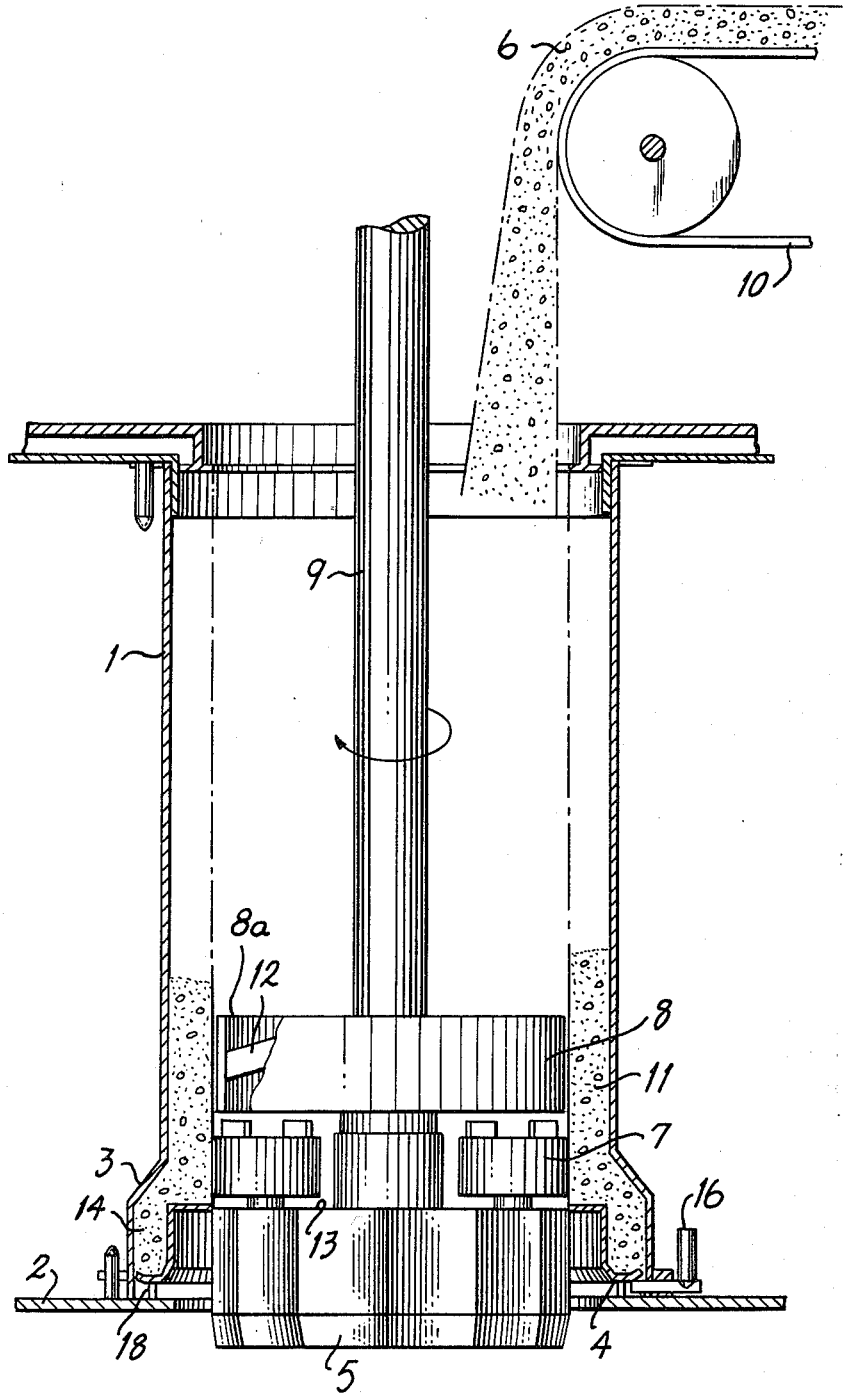
FIG. 1 shows a vertical section through apparatus for the radial centrifugal molding of concrete pipe, without the illustration of the frame portions, drive and control, and with the movable parts of the apparatus displayed in the lowermost position within the pipe section being formed.

FIG. 1 shows a pipe mold 1 supported on a rotary table 2. The inside surface of the mold forms the outside surface of a section of concrete pipe 11. Within the mold at its lower end, a bell 14 for the concrete pipe section is formed by a ring 4. The radially outer edge of the ring 4 bears against the mold 1. At the bottom, the ring 4 is supported on a rotating device, not shown. The radially inner edge of the ring is stepped upwardly from its radially outer edge and bears against the edge of a drum 5 so that the concrete 6 poured into the mold does not flow downwardly between the ring 4 and the drum 5. In axial section, the ring is angled at approximately 90° at its lower and upper ends relative to the upwardly extending portion of the ring.

Above the drum 5, four rollers are arranged which press the concrete outwardly against the inside surface of the mold 1. To prevent the sand or fine aggregate in the concrete 6 from becoming stuck between the drum 5 and the rollers 7, the rollers are spaced above the drum. During molding, the rollers roll on the inside surface of the pipe 11 being formed, or they can be driven.

A pressure wheel 8 encircles a drive shaft 9 above the rollers 7. The drive shaft 9 which drives the drum 5 can also drive the pressure wheel. It is not necessary, however, for the pressure wheel to rotate, it can be held stationary and raised together with the drum 5 and the rollers 7 during the molding of the concrete pipe section 11. Pressure wheel 8 functions to slow down or limit the flow of the concrete 6 upwardly from the bottom toward the top of the mold and toward the inside for increasing the downward pressure of the concrete. The pressure wheel 8 need only perform its function at the beginning of the production of a pipe section, that is, when the space forming the bell is being filled. The continued use of the pressure wheel during the formation of the pipe section does not have a negative influence on the concrete pipe. Accordingly, the pressure wheel may be maintained the same distance above the rollers 7 and the drum 5 during the entire production of the pipe section.

In the production of a concrete pipe section 11, the drum 5, the rollers 7 and the pressure wheel 8 on the shaft 9 are lowered downwardly through the top of the mold 1. The ring 4 is provided around the inside of the mold at its bottom. The downward movement of the parts is continued until they reach the lowermost position shown in FIG. 1. Subsequently, the shaft 9 and the ring 4 are rotated and the concrete is poured into the mold from a conveyor belt 10. Pressure wheel 8 has spokes 12 extending between a hub on the shaft 9 and the inside surface of the tubular circumferential surface part 8*a* of the wheel forming open spaces through which the concrete flows downwardly through the pressure wheel 8 and between the rollers 9 onto an upper plate 13 of the rotating drum 5. Due to the centrifugal effect generated by the rotating apparatus, the concrete is thrown outwardly against the inside surface of the mold 1. Rollers 7 press the concrete against the mold and, in the lowermost position of the rollers 7, the concrete flows into the region within the mold forming the bell 14 of the pipe section. Above the rollers 7, the pressure wheel 8 limits the free upward movement of the concrete toward the top and the inside of the mold, causing the concrete to flow upwardly against an increased resistance. The weight of the upwardly flowing concrete 6 applies additional pressure on the concrete in the portion of the mold forming the bell 14. This weight or pressure of concrete acting downwardly, increases the density of the concrete in the bell 14 of the pipe section. As the upwardly flowing concrete 6 reaches a certain level along the wall, it falls inwardly of the outer circumferential portion 8*a* of the pressure wheel and downwardly between the spokes 12 of the wheel until it is again forced outwardly against the inside surface of the pipe section being molded.

The amount of concrete supplied to the mold per unit of time via the concrete belt 10 is adjusted in accordance with the rate of rotation of the drum 5 and the rollers 7 and the speed at which the drum and rollers are being lifted upwardly within the mold. Accordingly, the diameter of the concrete pipe section as well as its wall thickness are taken into consideration.

When the bell portion 14 of the pipe section has reached a sufficient density, the rotary movement of the ring is stopped or switched off, and the drum 5, the rollers 7 and the pressure wheel are gradually moved upwardly as a unit until the entire axial length of the concrete pipe section is completed. The radially outer circumferentially extending surface of the drum 5 smoothens the inside surface of the concrete pipe section 11.

When the formation of the concrete pipe section is completed, the shaft together with the drum 5, the rollers 7 and the pressure wheel 8 fastened to the shaft, are pulled out of the mold and the rotary table 2 is turned by a certain angular amount so that another mold is positioned below the shaft whereby another production cycle can be commenced.

The molded concrete pipe section 11 has now reached such a strength that it can be displaced from the rotary table 2 and the mold 1 removed from it. The mold 1 can then be immediately placed back on the rotary table, ready to be used in forming another concrete pipe section.

Figure 2:
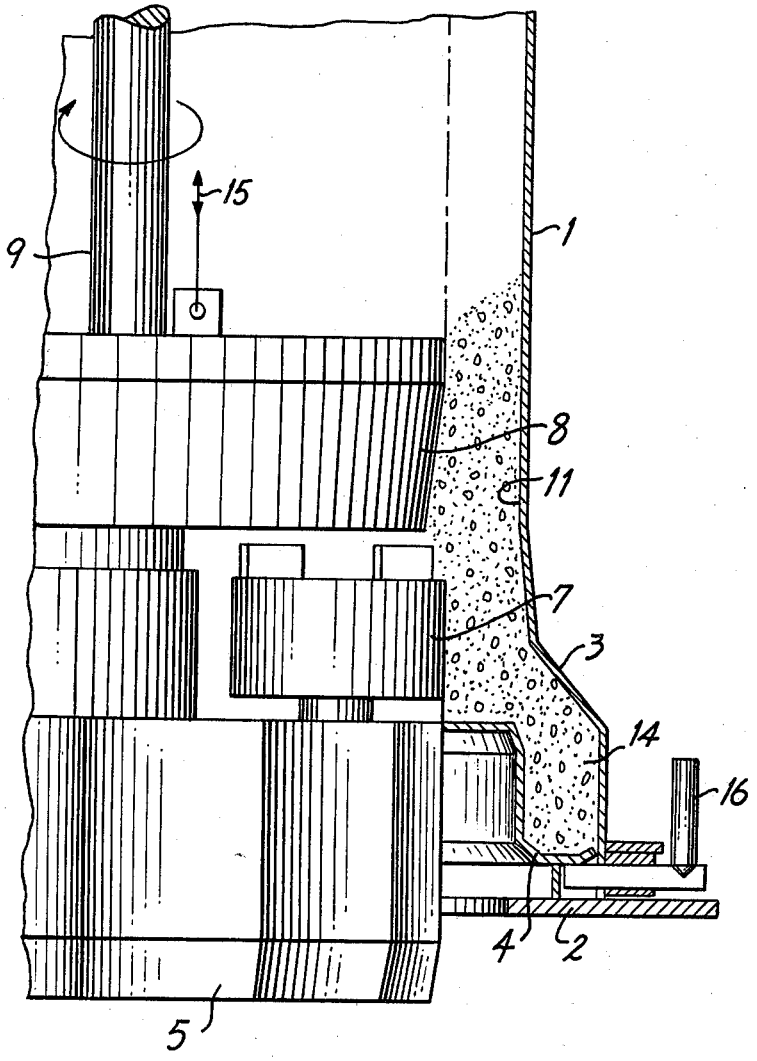
FIG. 2 is a partial enlarged section of another embodiment of the apparatus shown in FIG. 1.

In FIG. 2 another embodiment of the pressure wheel 8 is illustrated having an upper circular cylindrical section and a lower frusto-conical or truncated cone section which tapers inwardly in the downward direction. The upper circular cylindrical section can also have the shape of a truncated cone. Because of the shape of the pressure wheel 8, downward pressure in the concrete is increased and the density of the concrete in the bell 14 of the pipe section is further increased. Since the pressure wheel is needed only for molding the bell 14, in this embodiment, it is provided with a device 15 for lifting it as soon as the formation of the bell 14 is completed. The lifting device 15 can also be used in the embodiment shown in FIG. 1.

The drum is made up of individual cast elements which can be replaced after they become worn. The rollers 7 can be made out of cut tubular portions, while the pressure wheel may be formed of bent sheet metal forming the outer circumferential portion 8*a* with spokes 12 joining the outer portion to a hub. In the illustrated embodiments, the external diameter of the circular cylindrical portions of the pressure wheel 8 is equal to the diameter of the outer circumferential surface of the drum 5.

As shown in FIGS. 1 and 2, the ring 4 is connected to the mold 1 by means of pins or bolts 16.

Instead of a rotary table 2, the molds can be arranged in a row and, if necessary, the apparatus can be moved along the row from one mold to the next.

The rate of rotation of the shaft 9 may be, for example, in the range of between 30 and 180 rpm. The inside diameter of the finished concrete pipe sections can be up to 2.50 m. To provide continuous operation of the apparatus, only 2 to 4 molds are required for one concrete pipe diameter size.

The concrete used in forming the pipe sections may be of any type and may contain any type of filler, for example, plastics material. The cement usually used in concrete can be fully or partially replaced by polyester. As compared to existing apparatus for molding concrete pipe sections, the present invention has, among others, the following advantages:

The concrete pipe sections can be produced in a simpler and more economical manner, because only a few molds are needed. The molding of the bell at the lower end of the pipe section is positively influenced by the use of the pressure wheel with the bell having a higher density and strength than has been the case in the past. Moreover, the density in the bell is also positively influenced by the fact that the plate for centrifugally distributing the concrete is located below the rollers.

These various advantages are attained without the use of a vibrating device, accordingly the shaking of the apparatus and the generation of noise caused by such a device are avoided. By omitting the vibration device, the apparatus is simpler and its cost is lowered.

Another advantage of the present invention is that only one concrete mix and only one type of molding is used. As a result, zones in the concrete pipe section lacking in homogeneity which could cause ruptures, are avoided.

As mentioned above, no vibrating device is utilized in the apparatus embodying the present invention because experience has shown that such a device is unnecessary. It is possible, however, to provide the vibrating device, where the vibrations afford a positive influence on the flow of the material but do not effect any actual compaction of the material.

If, for any reason, the present invention includes the use of a vibrating device, the required vibration power is much lower than has been used in the past, so that there is less shaking of the apparatus with a lower noise level being generated.

While specific embodiments of the invention have been shown and described in detail to illustrate the application of the inventive principles, it will be understood that the invention may be embodied otherwise without departing from such principles.

What is claimed is:

1. Apparatus for the radial centrifugal molding of axially extending sections of concrete pipe having a bell at one end thereof comprising an upwardly extending mold for forming the radially outer axially extending circumferential surface of the section of concrete pipe, the lower end of said mold being shaped to form the bell end of the section of concrete pipe, an upwardly extending shaft located within and spaced inwardly from said mold, a drum mounted on said shaft for rotation within said mold, said drum having a radially outer circumferential surface spaced radially inwardly from the inner surface of said mold, a plurality of rotatable rollers located around said shaft above said drum, said rollers arranged to press the inside surface of the concrete poured into said mold in the radially outward direction against the inner surface of said mold, wherein the improvement comprises a pressure wheel located within said mold extending around said shaft and positioned upwardly from said rollers, said pressure wheel having a tubular circumferential surface part extending in the axial direction of and encircling said shaft and spaced radially outwardly from said shaft and radially inwardly from the inner surface of said mold so that said circumferential surface part contacts a tubular-like axially extending portion of the inner surface of the concrete pressed against the inner surface of said mold for limiting the upward flow of the poured concrete and increasing the concrete pressure in the space in the bottom of said mold forming the bell of the section of concrete pipe, and said pressure wheel forming open spaces between said circumferential surface part thereof and said shaft so that the concrete poured into the mold passes downwardly through the open spaces to said drum.

2. Apparatus, as set forth in claim 1, wherein the circumferential surface part of said pressure wheel has a circular cylindrical outer surface for contacting the concrete placed on the inner surface of said mold.

3. Apparatus, as set forth in claim 1, wherein the circumferential surface part of said pressure wheel has an upper circular cylindrical outer surface portion and a lower truncated cone-shaped outer surface portion extending downwardly from the upper surface portion with the lower surface portion tapering inwardly in the downward direction.

4. Apparatus, as set forth in claim 1, wherein the circumferential surface part of said pressure wheel has a truncated cone-shaped outer surface tapering inwardly in the downward direction.

5. Apparatus, as set forth in claim 1, 2, 3 or 4, including a lifting device for moving said pressure wheel upwardly within said mold relative to said rollers and said drum.

6. Apparatus, as set forth in claim 1, wherein a plurality of outwardly extending spokes are located within said pressure wheel extending between said shaft and said circumferential surface part for forming the open spaces therethrough.

7. Apparatus, as set forth in claim 1, wherein said pressure wheel is rotatably supported on said shaft.

8. Apparatus, as set forth in claim 1, wherein said pressure wheel is stationarily supported within said mold.

9. Apparatus, as set forth in claim 1, wherein a ring is located within and extends around the bottom of said mold for defining therewith the bell of the concrete pipe section being formed, and said ring being releasably connected to said mold.

10. Apparatus, as set forth in claim 9, including means for rotating said ring.

11. Apparatus, as set forth in claim 1, wherein the outside diameter of the circumferential surface part of said pressure wheel corresponds to the outside diameter of the circumferential portion of said drum.

* * * * *